US007308725B2

(12) United States Patent
Cazzini et al.

(10) Patent No.: US 7,308,725 B2
(45) Date of Patent: Dec. 18, 2007

(54) DEPLOYABLE AND/OR RETRACTABLE MATTRESS BOLSTERS

(75) Inventors: Karl Cazzini, Orchard Park, NY (US); Roland E. Flick, Elma, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 64 days.

(21) Appl. No.: 11/372,655

(22) Filed: Mar. 10, 2006

(65) Prior Publication Data

US 2007/0209118 A1 Sep. 13, 2007

(51) Int. Cl.
*A47C 27/10* (2006.01)

(52) U.S. Cl. ..... 5/713; 5/732; 5/731; 5/710

(58) Field of Classification Search ..... 5/713, 5/731–733, 706, 710
See application file for complete search history.

(56) References Cited

U.S. PATENT DOCUMENTS 3,921,232 A * 11/1975 Whyte ..... 428/12
4,941,221 A * 7/1990 Kanzler ..... 5/615
5,586,346 A * 12/1996 Stacy et al. ..... 5/710
5,623,736 A * 4/1997 Soltani et al. ..... 5/689
5,711,041 A * 1/1998 Chen ..... 5/708
6,178,578 B1 * 1/2001 Soltani et al. ..... 5/713
6,859,961 B1 3/2005 Barr
7,228,581 B2 * 6/2007 Mezue ..... 5/713
2007/0033738 A1 * 2/2007 Tu ..... 5/710

* cited by examiner

*Primary Examiner*—Patricia Engle
*Assistant Examiner*—William J. Kelleher
(74) *Attorney, Agent, or Firm*—Roach Brown McCarthy & Gruber, P.C.; Kevin D. McCarthy

(57) ABSTRACT

The present invention is directed to a therapeutic bed comprising a mattress. The mattress has a fluid cushion and a fluid pump. The fluid cushion has a fluid support surface, a retractable/deployable bolster, and a closure mechanism. The fluid support surface has a top surface designed to receive a patient thereon. The closure mechanism corresponds to the retractable/deployable bolster and allows the retractable/deployable bolster to be deployed or retracted. When the retractable/deployable bolster is deployed the retractable/deployable bolster protrudes from the top surface and is positioned about a portion of the patient's perimeter. When the retractable/deployable bolster is retracted the closure mechanism is positioned over the retractable/deployable bolster to prevent the retractable/deployable bolster from protruding from the top surface. And the fluid pump provides a fluid to the fluid cushion.

29 Claims, 3 Drawing Sheets

DEPLOYABLE AND/OR RETRACTABLE MATTRESS BOLSTERS

FIELD OF THE INVENTION

The present invention relates to therapeutic beds.

BACKGROUND OF THE INVENTION

Therapeutic beds are in wide use in healthcare facilities. The terms "healthcare facilities" and "therapeutic beds" have conventional meanings. For example, "healthcare facilities" include and are not limited to hospitals, rehabilitation centers, long-term care facilities, hospice centers, and on some occasions an individual's home. Therapeutic beds are used not only for patients recovering from trauma or medical procedures, but also for invalid or elderly patients in long-term care facilities. The term "therapeutic bed" is used herein to broadly identify a bed which provides some patient treatment through a fluid cushion. The fluid in the fluid cushion can be air and/or an aqueous solution.

Gaymar Industries, Inc. manufactures therapeutic beds and has for numerous years. An example of a therapeutic mattress is Gaymar's Clini-Dyne® mattress. The Clini-Dyne® mattress system 10 and variations thereof are illustrated in FIGS. 1 and 2. The mattress system 10 has a mattress 12 positioned over a support surface 100. The support surface 100 can provide the mattress (a) remains in a supine position as illustrated in FIG. 1, or (b) is able to undergo a gatching process as illustrated in FIG. 2. The gatching process occurs when the support surface 100 is able to position the mattress 12 from a supine position to an inclined position and possibly a cardiac chair position, positions in between the cardiac chair position and the supine position and vice versa.

The mattress 12 contains a fluid cushion 14 (illustrated in broken lines in FIGS. 1 and 2 and for purposes of this discussion receives air). The air cushion 14 is filled with air to a desired air pressure and/or size through an air pump 16. The air pump 16 is positioned within the mattress 12 as illustrated in FIG. 1 or exterior to the mattress 12 as illustrated in FIG. 2. The pressure within the air cushion 14 can be monitored by an air pressure sensor positioned within (a) the air cushion, (b) a conduit that connects the air pump to the air cushion, and/or (c) the air pump. The size of the air cushion can also be monitored by (a) the quantity of light in the air cushion, (b) the distance between two position sensors within the cushion and (c) equivalents thereof. The methods in which the air cushion 14 is filled to a particular air pressure and/or size are known to those of ordinary skill in the art.

Whatever the mattress 12 configurations, the air cushion 14 is at least partially enclosed by a cover material 18. It is also understood that additional air and/or fluid cushions 14*a* may be incorporated in the present invention to provide rotation capabilities, vibration capabilities, turn-assist capabilities, percussion capabilities, and/or any other therapeutic characteristics as illustrated in FIG. 3. If the cushion 14 and/or the additional cushions are limited to providing air, then those cushions can provide low-air loss capabilities. It is also understood that other bedding materials can be positioned above, on the side of, and/or below the cushions 14 to obtain desired results. An example of other bedding materials includes gelastic type materials 15, and/or foam-like materials 22.

The mattress system 10 also normally has guard rails 20 (FIG. 1) and/or a crib 22 (FIG. 3) to decrease the chances that the patient falls off the mattress system 10. The crib 22 is normally a foam-like material and/or inflated bladder positioned about the perimeter of the cushion 14. In many instances, the crib 22 and/or the guard rail 20 prevent patients from falling off the bed.

It is also generally known that the types of patients for whom a therapeutic bed is best suited, may have a tendency to roll off the bed and onto the floor. Alternatively, many of these patients are thin and frail and exhibit a tendency to roll to the side of the mattress and/or become trapped between the side of the therapeutic mattress and the guard rail 20 lining the sides of a therapeutic bed. Both of these circumstances are fraught with danger to the patient, and with potential liability for the health care facility. Accordingly, it has been determined that cribs 22 and/or guard rail 20 may not be sufficient.

Barr in U.S. Pat. No. 6,859,961 attempts to address that problem. Barr discloses detachable/attachable raised bolsters positioned on the mattress cover. The bolsters are positioned along (a) the side edges of the bed, leaving at least one entry-exit point for the patient along each side of the bed, and (b) the foot of the bed. Those bolsters can be easily detached from the bed cover by the patient's movement and therefore not provide the desired safety standards. The present invention is designed to decrease the ease in which the bolter design can be compromised.

SUMMARY OF THE INVENTION

The present invention is directed to a therapeutic bed comprising a mattress. The mattress has a fluid cushion and a fluid pump. The fluid cushion has a fluid support surface, a retractable/deployable bolster, and a closure mechanism. The fluid support surface has a top surface designed to receive a patient thereon. The closure mechanism corresponds to the retractable/deployable bolster and allows the retractable/deployable bolster to be deployed or retracted. When the retractable/deployable bolster is deployed the retractable/deployable bolster protrudes from the top surface and is positioned about a portion of the patient's perimeter. When the retractable/deployable bolster is retracted the closure mechanism is positioned over the retractable/deployable bolster to prevent the retractable/deployable bolster from protruding from the top surface. And the fluid pump provides a fluid to the fluid cushion.

DETAILED DESCRIPTION OF THE PREFERRED EMBODIMENT

The present invention will now be described more fully hereinafter with reference to the accompanying drawings, in which preferred embodiments of the invention are shown.

Figure 1:
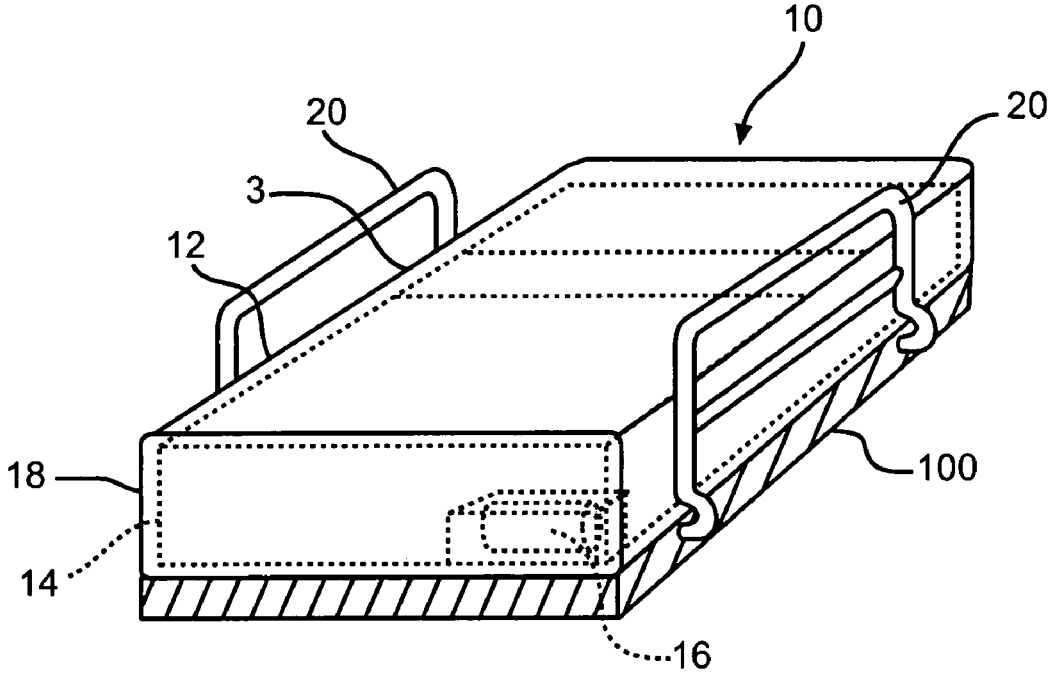
FIG. 1 (Prior Art)
FIG. 1 illustrates a prior art embodiment of a therapeutic bed in a supine configuration.
Figure 2:
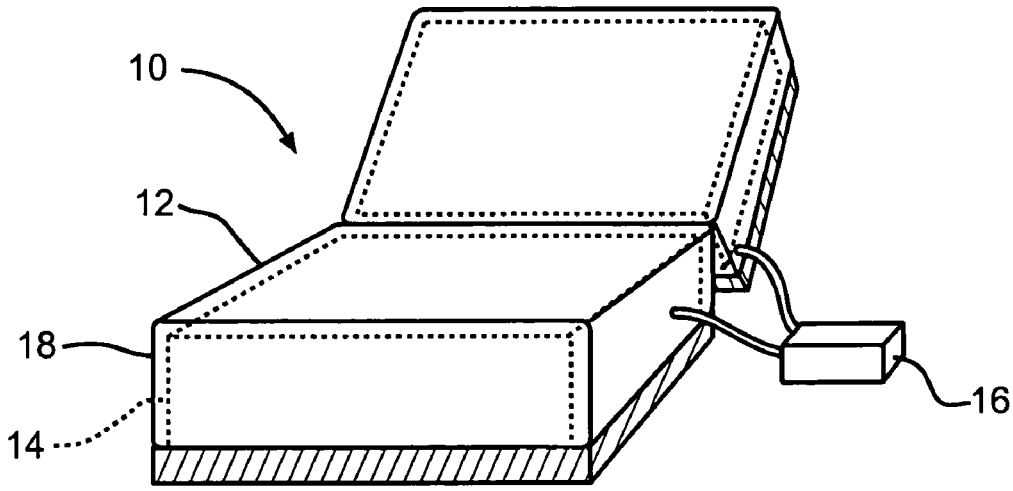
FIG. 2 (Prior Art)
FIG. 2 illustrates a prior art embodiment of a therapeutic bed in a gatching configuration.
Figure 3:
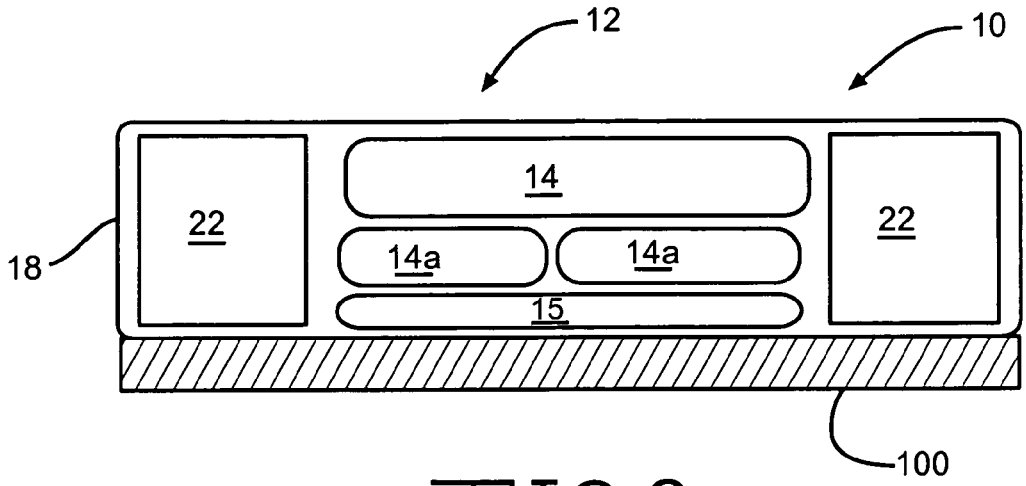
FIG. 3 is a cross-sectional view of an alternative embodiment of FIG. 1 taken along lines 3-3.

The present invention is a modification of the prior art therapeutic beds 10 illustrated in FIGS. 1 to 3 and other types of therapeutic beds. For the present invention, the modifications are directed toward the fluid cushion 14 and possibly the cover 18.

Fluid Cushion

Figure 4:
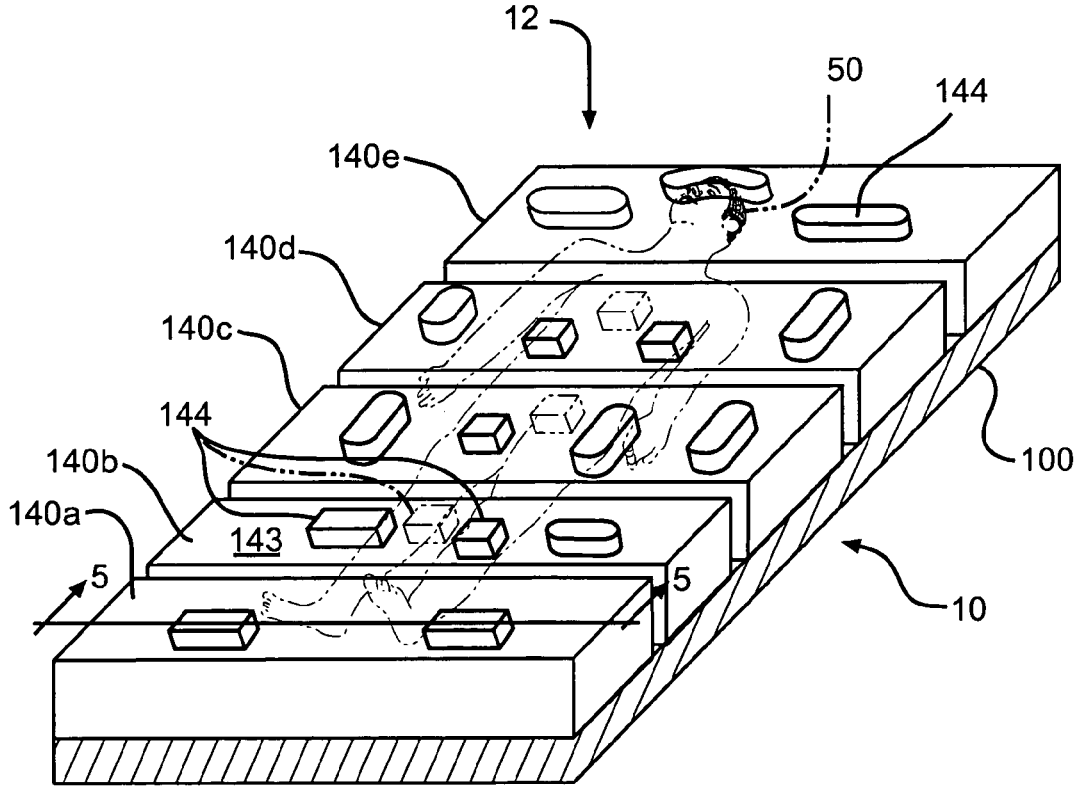
FIG. 4 illustrates the present invention without a cover.

FIG. 4 illustrates a mattress 12 without a cover 18 or a crib 22. Instead, the mattress 12 has a plurality of modified fluid cushions 140*a*, 140*b*, 140*c*, 140*d*, and 140*e* (which can also be incorporated into a single cushion). Each modified fluid cushion 140*a-e* can be divided into two sections as illustrated in FIGS. 5 and 6.

Figure 5:
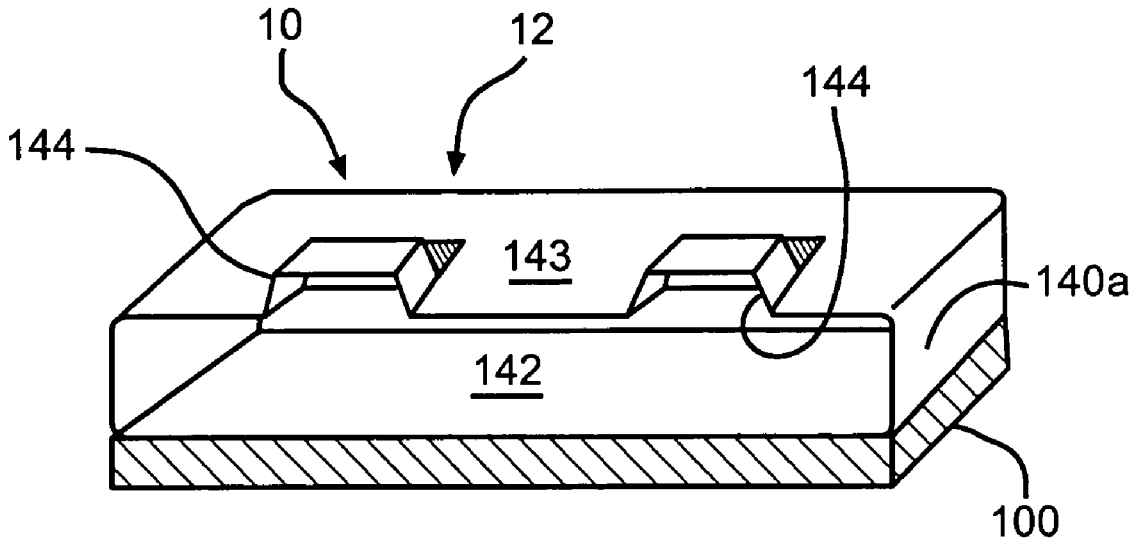
FIG. 5 is a view of FIG. 4 taken along the lines of 5-5.

FIG. 5 is a cross-sectional view of FIG. 4 taken along the line 5-5 that illustrates the modified fluid cushion 140*a* in a deployed state. The first section is the conventional cushion area 142. The conventional cushion area 142 is designed to support a patient 50 thereon as illustrated in FIG. 4. Reverting to FIG. 5, the conventional cushion area 142 is found in cushions used in association with therapeutic beds 10.

The second section is a bolster section 144. As illustrated in FIGS. 4 and 5, the bolster section 144 in the deployed configuration protrudes toward the patient 50. The bolster section 144 is positioned on the fluid cushion 140*a-e* to surround at least a portion of the patient 50 positioned on the mattress 12 as illustrated in FIG. 4.

Figure 6:
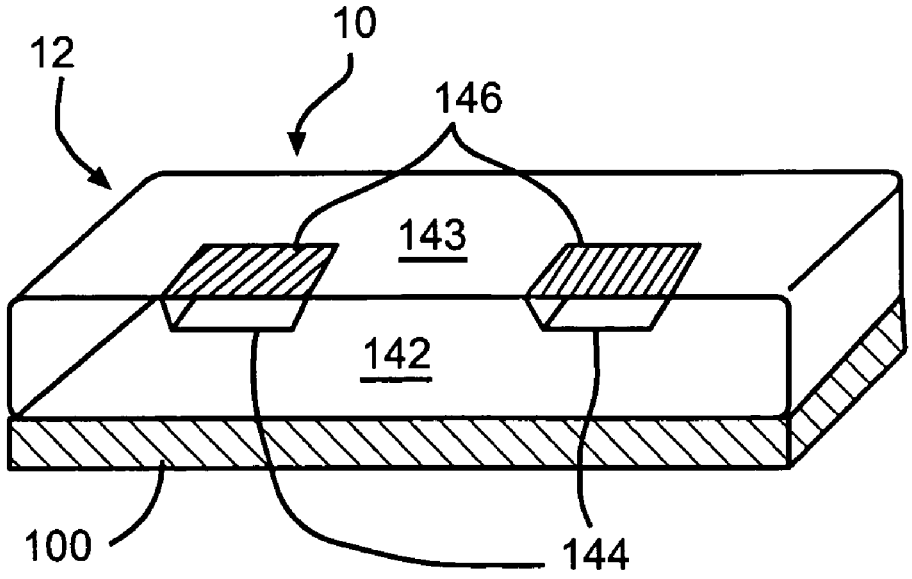
FIG. 6 is an alternative embodiment of FIG. 5.

FIG. 6 illustrates the bolter section 144 in a retracted position. The retracted position has the bolster section 144 contained within the conventional cushion area 142. The bolster section 144 remains contained within the conventional cushion area 142 through a closure mechanism 146.

The closure mechanism 146 is any apparatus that allows the bolster section 144 to be deployed as illustrated in FIGS. 4 and 5, and retracted as illustrated in FIG. 6. Examples of the closure mechanism 146 can be a flap, a zipper, a zip-lock sealing apparatus, a lace through apertures, hook and loop apparatus, or combinations thereof. The closure mechanism 146 is positioned on the conventional cushion area's 142 top surface 143 and at the border between the conventional cushion area 142 and the bolster area 144. That way, the top surface 143 can be as smooth as possible. In many instances, the closure mechanism should be of a material that does not increase the pressure applied to the patient 50.

Obviously, numerous bolster sections 144 can be positioned on each fluid cushion 140*a-e*. Depending on the size of the patient 50 the bolster sections 144 in each fluid cushion 140*a-e* can be deployed and/or retracted in order to surround the patient 50 as illustrated in FIG. 4 and variations thereof. Alternatively, the fluid cushion 140*a-e* can have one set of bolster sections 144 under a one-size fits all protocol. That being said, the numerous bolster sections 144 embodiment is the preferred embodiment.

The present invention also decreases the chances of injury to a patient who thrashes and/or has seizures. The positioning and/or deploying of the bolster sections can decrease damages to the patient's head, arm, legs, chest, and/or feet. Accordingly, the bolster sections 144 can be deployed around the patient's head, foot, feet, arms, legs, torso, abdomen, neck, and combinations thereof and retracted when a bolster area 144 is positioned below the patient (see dotted lines) to accomplish that objective as illustrated in FIG. 4.

Cover

The cover 18 can be a loose fitting material, a tight fitting material or a material between a loose fitting material and a tight fitting material. If the cover 18 is loose, there is no need to modify the cover 18 in relation to the present invention to a fluid cushion 12 having a bolster section 144 embodiment. Modifications are not needed because the bolster section 144 can be deployed without the cover 18 essentially retracting and/or partially retracting the bolster section 144.

Alternatively, if the cover 18 is a tight fitting material or variations thereof that could at least partially retract the bolster section 144, then the cover 18, if used, must be modified. The cover 18 modifications can include apertures, re-sealable or not, that correspond to each bolster section 144 of the fluid cushion 140*a-e*. The re-sealablity of the aperture can be accomplished by closing the aperture with a flap, a zipper, a zip-lock sealing apparatus, a lace through apertures, hook and loop apparatus, or combinations thereof.

Remainder of the Therapeutic Bed

The remaining portions of the therapeutic bed 10 operate in the same way that Gaymar's other therapeutic beds operate. The fluid pumps provide the desired fluid to the fluid cushions 140 to obtain a desired fluid pressure and/or size. Moreover, the fluid pressure and/or size of the fluid cushions 140 can be monitored by various types of sensors that are used in Gaymar's other therapeutic beds.

The positioning of the fluid pumps can be (a) exterior to the mattress 12 or (b) in the interior of the mattress 12. A fluid pump in the interior of the mattress means the mattress 12 can be a self-contained mattress 12.

It is also understood that additional fluid cushions 14*a* may be incorporated with the present invention to provide rotation capabilities, vibration capabilities, turn-assist capabilities, percussion capabilities, and/or any other therapeutic characteristics as illustrated in FIG. 3. If any of the modified cushion(s) 140 and/or the additional cushions 14*a* is limited to providing air, then those air-cushions can provide low-air loss capabilities. It is also understood that other bedding materials can be positioned above, on the side of, and/or below the cushions 14 to obtain desired results. An example of other bedding materials includes gelastic type materials 15, and/or foam-like materials 22.

The mattress system 10 can also have guard rails 20 (shown in FIG. 1) and/or a crib 22 (shown in FIG. 3) to decrease the chances that the patient can fall off the mattress system 10. The crib 22 is normally a foam-like material and/or an inflatable bladder positioned about the perimeter of the cushion 14.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

We claim:

1. A therapeutic bed comprising a mattress having (A) a first fluid cushion, the first fluid cushion having (a) a first fluid support surface having a first top surface adapted to receive a patient thereon, (b) a first retractable/deployable bolster inflated via the first fluid cushion, and (c) a first closure mechanism for the first retractable/deployable bolster that allows the first retractable/deployable bolster to be deployed or retracted, wherein when (I) the first retractable/deployable bolster is deployed the first retractable/deployable bolster (i) protrudes from the first top surface and (ii) is positioned about a portion of the patient's left side and a portion of the patient's right side when the patient is positioned entirely on the mattress to inhibit the patient from rolling to the side of the mattress, and (II) the first retractable/deployable bolster is retracted the first closure mechanism is positioned over the first retractable/deployable bolster to prevent the first retractable/deployable bolster from protruding from the first top surface and the first retractable/deployable bolster is retracted when the first retractable/deployable bolster is positioned below the patient; and (B) a fluid pump provides a fluid to the first fluid cushion.

2. The therapeutic bed of claim 1 wherein the mattress further comprises a second fluid cushion, wherein (A) the second fluid cushion has (a) a second fluid support surface having a second top surface adapted to receive a patient thereon, (b) a second retractable/deployable bolster, and (c) a second closure mechanism for the second retractable/deployable bolster that allows the second retractable/deployable bolster to be deployed or retracted wherein when (I) the second retractable/deployable bolster is deployed the second retractable/deployable bolster (i) protrudes from the second top surface and (ii) is positioned about a portion of the patient's left side and a portion of the patient's right side when the patient is positioned entirely on the mattress to inhibit the patient from rolling to the side of the mattress, and (II) the second retractable/deployable bolster is retracted the second closure mechanism is positioned over the second retractable/deployable bolster to prevent the second retractable/deployable bolster from protruding from the second top surface and the second retractable/deployable bolster is retracted when the second retractable/deployable bolster is positioned below the patient; and (B) the second fluid cushion receives fluid from the fluid pump.

3. The therapeutic bed of claim 1 wherein the first fluid cushion further comprises (a) a secondary retractable/deployable bolster and when the secondary retractable/deployable bolster is deployed the secondary retractable/deployable bolster protrudes from the first top surface and is positioned about a portion of the patient's perimeter, and (b) a secondary closure mechanism for the secondary retractable/deployable bolster that allows the secondary retractable/deployable bolster to be deployed or retracted wherein when (I) the secondary retractable/deployable bolster is deployed the secondary retractable/deployable bolster (i) protrudes from the first top surface and (ii) is positioned about a portion of the patient's left side and a portion of the patient's right side when the patient is positioned entirely on the mattress to inhibit the patient from rolling to the side of the mattress, and (II) the secondary retractable/deployable bolster is retracted the secondary closure mechanism is positioned over the secondary retractable/deployable bolster to prevent the secondary retractable/deployable bolster from protruding from the first top surface and the secondary retractable/deployable bolster is retracted when the secondary retractable/deployable bolster is positioned below the patient.

4. The therapeutic bed of claim 1 further comprising a mattress support surface positioned below the mattress.

5. The therapeutic bed of claim 4 wherein the mattress support surface is a supine position.

6. The therapeutic bed of claim 4 wherein the mattress support surface is able to undergo a gatching process.

7. The therapeutic bed of claim 1 wherein the fluid pump provides air to the fluid cushion.

8. The therapeutic bed of claim 7 wherein the fluid cushion has low-loss air capabilities.

9. The therapeutic bed of claim 1 wherein the fluid pump provides an aqueous fluid to the fluid cushion.

10. The therapeutic bed of claim 1 wherein the mattress further comprises a crib.

11. The therapeutic bed of claim 1 wherein the therapeutic bed further comprises a guard rail.

12. The therapeutic bed of claim 1 wherein the mattress further comprises a third fluid cushion that provides rotation capabilities, vibration capabilities, turn-assist capabilities, percussion capabilities, and combinations thereof.

13. The therapeutic bed of claim 12 wherein the third fluid cushion is positioned below the first fluid cushion.

14. The therapeutic bed of claim 2 wherein the mattress further comprises a third fluid cushion that provides rotation capabilities, vibration capabilities, turn-assist capabilities, percussion capabilities, and combinations thereof.

15. The therapeutic bed of claim 14 wherein the third fluid cushion is positioned below the first fluid cushion and the second fluid cushion.

16. The therapeutic bed of claim 1 wherein the mattress comprises a non-fluidic cushion positioned below the first fluid cushion.

17. The therapeutic bed of claim 16 wherein the non-fluidic cushion is a gelastic product and/or a foam product.

18. The therapeutic bed of claim 1 wherein the first closure mechanism is a flap, a zipper, a zip-lock sealing apparatus, a lace through apertures, hook and loop apparatus, or combinations thereof.

19. The therapeutic bed of claim 2 wherein the second closure mechanism is a flap, a zipper, a zip-lock sealing apparatus, a lace through apertures, hook and loop apparatus, or combinations thereof.

20. The therapeutic bed of claim 3 wherein the first retractable/deployable bolster is deployed and the secondary retractable/deployable bolster is retracted.

21. The therapeutic bed of claim 3 wherein the first retractable/deployable bolster and the secondary retractable/deployable bolster are retracted.

22. The therapeutic bed of claim 3 wherein the first retractable/deployable bolster and the secondary retractable/deployable bolster are deployed.

23. The therapeutic bed of claim 1 wherein the fluid pump is positioned in the mattress.

24. The therapeutic bed of claim 1 wherein the fluid pump is positioned exterior to the mattress.

25. The therapeutic bed of claim 1 wherein the mattress has a cover.

26. The therapeutic bed of claim 25 wherein the cover has an aperture that corresponds with the location of the first retractable/deployable bolster.

27. The therapeutic bed of claim 26 wherein the aperture can be closed by a flap, a zipper, a zip-lock sealing apparatus, a lace through apertures, hook and loop apparatus, or combinations thereof.

28. The therapeutic bed of claim 1 wherein the first retractable/deployable bolster is positioned around the patient's head, foot, feet, arms, legs, torso, abdomen, neck, and combinations thereof.

29. A method of using a therapeutic bed comprising (A) positioning a patient on a mattress having (I) a first fluid cushion having (a) a first fluid support surface having a top surface adapted to receive a patient thereon, (b) a first retractable/deployable bolster inflated via the first fluid cushion, and (c) a first closure mechanism for the first retractable/deployable bolster that allows the first retractable/deployable bolster to be deployed or retracted; and (II) a fluid pump provides a fluid to the first fluid cushion;

(B) deploying the first retractable/deployable bolster so (i) the first retractable/deployable bolster protrudes from the top surface and (ii) is positioned about a portion of the patient's left side and a portion of the patient's right side when the patient is positioned entirely on the mattress to inhibit the patient from rolling to the side of the mattress;

(C) retracting the first retractable/deployable bolster when the first retractable/deployable bolster is positioned below the patient.

* * * * *